US009644545B2

(12) United States Patent
Marlett et al.

(10) Patent No.: US 9,644,545 B2
(45) Date of Patent: May 9, 2017

(54) CONTROL OF ENGINE EXHAUST BRAKING

(71) Applicant: GM GLOBAL TECHNOLOGY OPERATIONS LLC, Detroit, MI (US)

(72) Inventors: Chad E. Marlett, Plymouth, MI (US); Luca Scavone, Moncalieri (IT); Francesco Cianflone, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 91 days.

(21) Appl. No.: 14/695,656

(22) Filed: Apr. 24, 2015

(65) Prior Publication Data

US 2016/0312712 A1 Oct. 27, 2016

(51) Int. Cl.

| | |
|---|---|
| ***F02D 9/06*** | (2006.01) |
| *F02D 9/04* | (2006.01) |
| *F02D 9/08* | (2006.01) |
| *F02B 37/24* | (2006.01) |

(52) U.S. Cl.

CPC ..... *F02D 9/06* (2013.01); *F02B 37/24* (2013.01); *F02D 9/08* (2013.01)

(58) Field of Classification Search

CPC ..... F02D 9/06; F02D 9/04

USPC ..... 123/323, 559.1, 564; 60/602

See application file for complete search history.

(56) References Cited

U.S. PATENT DOCUMENTS

| | | | | |
|---|---|---|---|---|
| 5,884,482 | A * | 3/1999 | Lange | F02B 41/10 60/624 |
| 7,461,629 | B2 * | 12/2008 | Ball | F02D 23/00 123/323 |
| 2002/0100280 | A1 * | 8/2002 | McKinley | F02D 9/04 60/605.2 |
| 2011/0100324 | A1 * | 5/2011 | Xin | F02D 13/04 123/322 |
| 2013/0255624 | A1 * | 10/2013 | Chaves | F02D 13/04 123/321 |
| 2014/0244116 | A1 * | 8/2014 | Andrasko | B60W 10/198 701/48 |
| 2015/0144097 | A1 * | 5/2015 | Lingens | F02B 37/24 123/323 |
| 2016/0138495 | A1 * | 5/2016 | Granstrom | F02B 37/24 701/108 |

* cited by examiner

*Primary Examiner* — Mahmoud Gimie
(74) *Attorney, Agent, or Firm* — Quinn IP Law

(57) ABSTRACT

A method of controlling exhaust braking in an internal combustion engine is disclosed. The engine includes an exhaust system, an exhaust pressure modulation valve, and a variable geometry turbocharger having adjustable vanes. The method includes restricting a flow of the exhaust gas through the exhaust system via a first partially-closed position of the valve. The valve's first partially-closed position increases the exhaust backpressure in the engine up to a first pressure value and generates a first stage of exhaust braking by the engine. The method also includes, following the increase of exhaust backpressure in the engine up to the first pressure value, restricting a flow of the exhaust gas through the turbocharger via closing the turbocharger's adjustable vanes. The closing of the turbocharger's adjustable vanes increases the exhaust backpressure up to a second pressure value in the exhaust system and generates a second stage of exhaust braking by the engine.

17 Claims, 3 Drawing Sheets

CONTROL OF ENGINE EXHAUST BRAKING

TECHNICAL FIELD

The present disclosure relates to control of exhaust braking in an internal combustion engine.

BACKGROUND

Internal combustion engines frequently employ boosting devices to compress the airflow before the air enters the intake manifold of the engine in order to increase power and efficiency. A common boosting device employed in internal combustion engines is a turbocharger that uses a gas turbine motivated by the engine exhaust flow to drive a gas compressor for engine intake air. Some engines employ variable-geometry turbochargers (VGTs). A VGT is a type of a turbocharger usually designed to allow the effective aspect ratio (A:R) of the turbocharger to be altered in line with engine speed, and thus facilitate increased engine operating efficiency. VGTs tend to be more common on compression-ignition or diesel engines, as compared to spark-ignition or gasoline engines, because lower exhaust temperatures of a diesel engine provides a less extreme environment for the movable components of the VGT.

Exhaust braking is a means of slowing a diesel engine by closing off a path of exhaust flow from the engine when fuel to the engine has been shut off. Such closing off the engine exhaust flow generates backpressure inside the engine by causing the exhaust gases to be compressed inside the engine's exhaust manifold and its cylinder(s). Since the exhaust gases are being compressed and there is no fuel being supplied, the engine rotation is impeded, thus slowing down the vehicle. Exhaust braking essentially creates a major restriction in the exhaust system, and creates substantial exhaust backpressure to retard engine speed and offer some supplemental vehicle braking In most cases, an exhaust brake is so effective that it can slow a heavily loaded vehicle on a downgrade without ever applying the vehicle's service, such as friction, brakes.

SUMMARY

A method of controlling exhaust braking in an internal combustion engine is disclosed. The engine includes an exhaust system configured to channel engine exhaust gas to the ambient, an exhaust pressure modulation (EPM) valve, and a variable geometry turbocharger (VGT) having adjustable vanes. The method includes restricting a flow of the exhaust gas through the exhaust system by a controller via a first partially-closed position of the EPM valve. The first partially-closed position of the EPM valve increases exhaust backpressure in the engine up to a first pressure value and generates a first stage of engine exhaust braking The method also includes, following the increase of the exhaust backpressure in the engine up to the first pressure value, restricting a flow of the exhaust gas through the VGT by the controller via closing the adjustable vanes of the VGT. The closing of the adjustable vanes of the VGT increases the exhaust backpressure up to a second pressure value in the exhaust system and generates a second stage of engine exhaust braking The method may also include, following the increase of the exhaust backpressure in the engine up to the second pressure value, restricting the flow of the exhaust gas through the exhaust system by the controller via a second partially-closed position of the EPM valve. The second partially-closed position of the EPM valve increases the exhaust backpressure in the exhaust system up to a third pressure value and generates a third stage of engine exhaust braking The first pressure value may be in a range of 125-175 KPa, the second pressure value may be in a range of 325-350 KPa, and the third pressure value may be greater than 350 KPa.

The EPM valve may be also configured to route the exhaust gas from the exhaust system to the VGT for exhaust gas recirculation (EGR).

The VGT may be a light-duty turbocharger that includes a single-axle arrangement for mounting of the adjustable vanes.

The method may also include unrestricting the flow of the exhaust gas through the VGT by the controller via opening the adjustable vanes of the VGT. Opening the adjustable vanes of the VGT in such a case is intended to decrease the exhaust backpressure down to the first pressure value in the exhaust system. Additionally, following the decrease of the exhaust backpressure in the engine down to the first pressure value, the method may include unrestricting the flow of the exhaust gas through the exhaust system by the controller via opening the EPM valve. Opening the EPM valve in such a case is intended to decrease the exhaust backpressure in the engine below the first pressure value. Once the exhaust backpressure in the engine has been decreased below the first pressure value, engine exhaust braking is discontinued.

The opening of the EPM valve may include ramping, i.e., incrementing gradually, opening the EPM valve to progressively reduce the exhaust backpressure in the engine.

Another embodiment of the disclosure is directed to a vehicle having an internal combustion engine that employs the EPM valve, the VGT, and the controller to control engine exhaust braking as described above.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
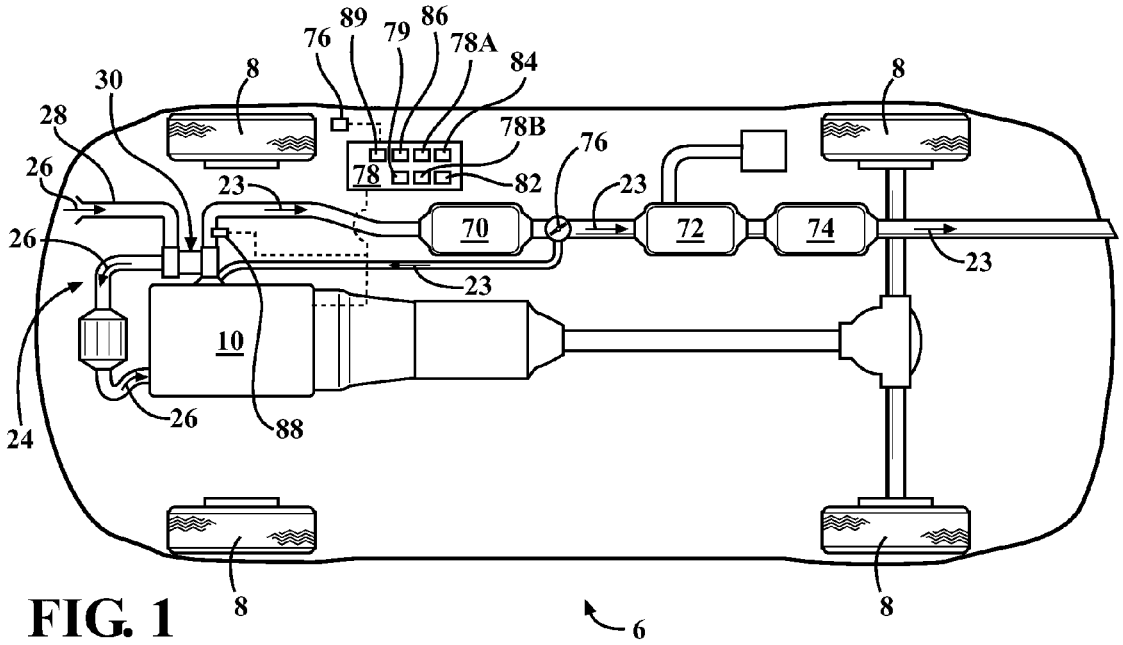
FIG. 1 is a schematic illustration of a vehicle having an internal combustion engine with a variable geometry turbocharger (VGT) and a system for controlling exhaust braking in the engine according to the disclosure.
Figure 2:
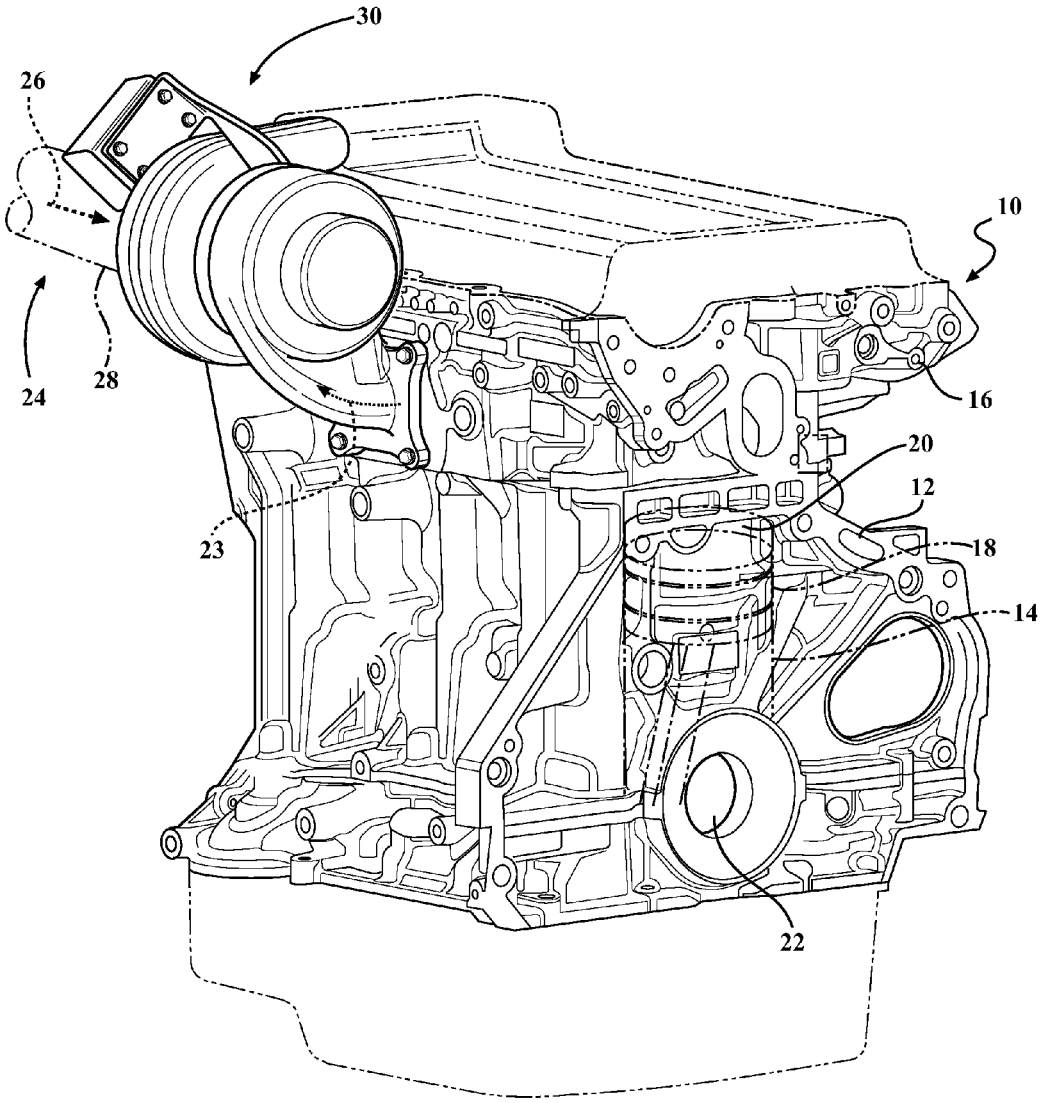
FIG. 2 is a schematic perspective close-up view of the engine shown in FIG. 1.

Referring to the drawings wherein like reference numbers correspond to like or similar components throughout the several figures, FIG. 1 illustrates a vehicle 6 having a plurality of wheels 8 that may be driven by an internal combustion engine (ICE) 10. As shown in FIG. 2, the ICE 10 includes a cylinder block 12 with a plurality of cylinders 14 arranged therein. The ICE 10 also includes a cylinder head 16. Each cylinder 14 includes a piston 18 configured to reciprocate therein. Although the ICE 10 may be either a spark-ignition, i.e., gasoline, engine, or a compression-ignition, i.e., diesel, engine, the present disclosure will focus primarily on diesel configuration of the ICE.

As shown in FIG. 2, combustion chambers 20 are formed within the cylinders 14 between the bottom surface of the cylinder head 16 and the tops of the pistons 18. As known by those skilled in the art, combustion chambers 20 are configured to receive fuel and air such that a fuel-air mixture may form for subsequent combustion therein. The ICE 10 also includes a crankshaft 22 configured to rotate within the cylinder block 12. The crankshaft 22 is rotated by the pistons 18 as a result of increased pressure from the burning fuel-air mixture in the combustion chambers 20. After the air-fuel mixture is burned inside a specific combustion chamber 20, the reciprocating motion of a particular piston 18 serves to expend post-combustion exhaust gases 23 from the respective cylinder 14.

A flow of the post-combustion exhaust gases 23 may be controlled to provide exhaust braking in the ICE 10. As understood by those skilled in the art, exhaust braking is a means of slowing a diesel engine, e.g., the ICE 10, by restricting or closing a path of exhaust flow from the engine when fuel to the engine has been shut off. The restriction of the engine exhaust gas flow causes the exhaust gases to be compressed inside the engine and generate significantly increased backpressure inside the engine. The increased backpressure slows down the engine, which in turn decelerates the host vehicle. The amount of torque generated by the engine when exhaust braking is applied is generally proportional to the backpressure generated inside the engine.

The ICE 10 also includes an induction system 24 configured to channel an airflow 26 from the ambient to the cylinders 14. The induction system 24 includes an intake air duct 28, a variable geometry turbocharger (VGT) 30, and an intake manifold (not shown). Although not shown, the induction system 24 may additionally include an air filter upstream of the VGT 30 for removing foreign particles and other airborne debris from the airflow 26. The intake air duct 28 is configured to channel the airflow 26 from the ambient to the VGT 30, while the VGT is configured to pressurize the received airflow, and discharge the pressurized airflow to the intake manifold. The intake manifold in turn distributes the previously pressurized airflow 26 to the cylinders 14 for mixing with an appropriate amount of fuel and subsequent combustion of the resultant fuel-air mixture.

Figure 3:
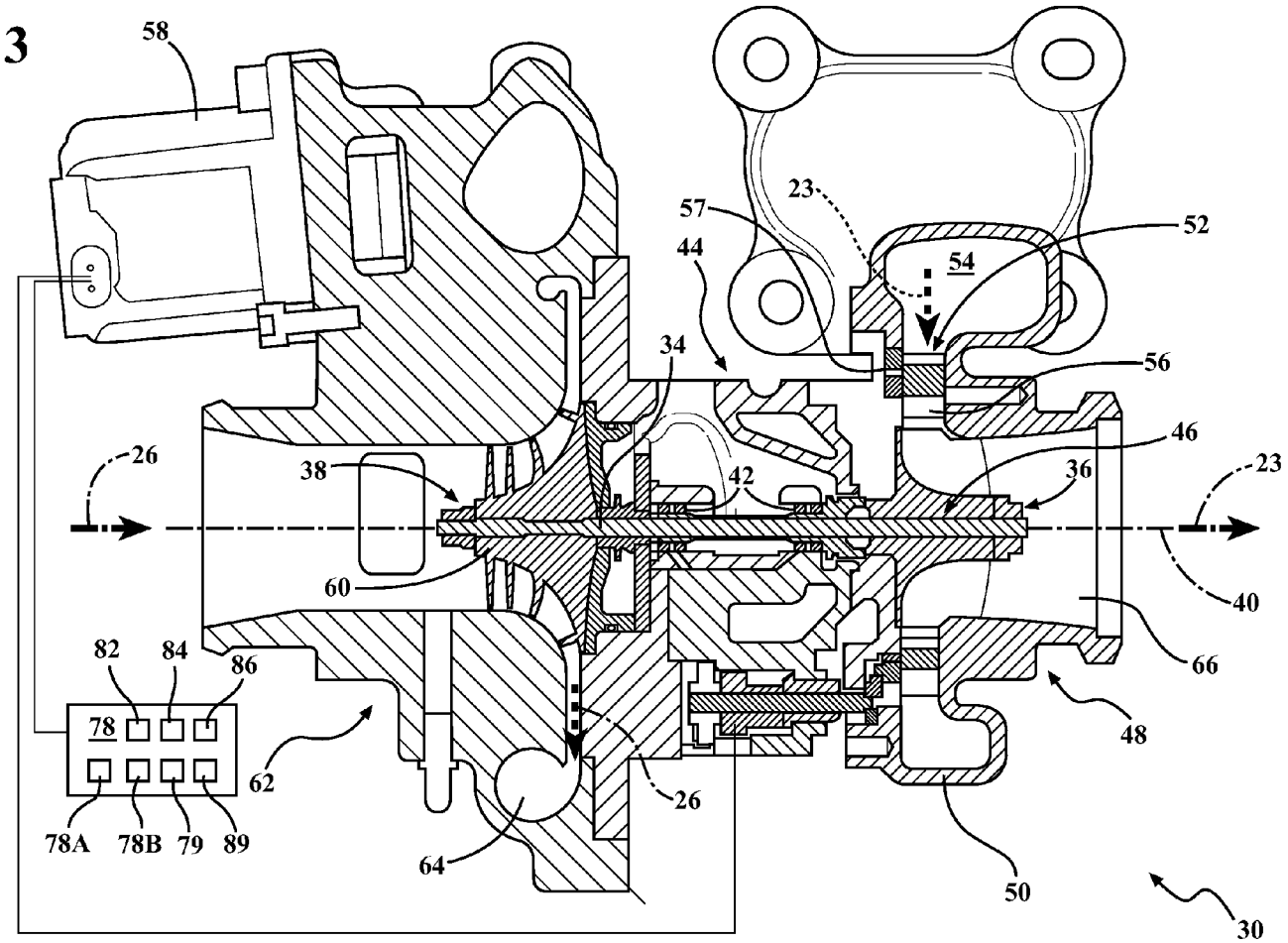
FIG. 3 is a schematic cross-sectional view of the VGT shown in FIGS. 1 and 2.

As shown in FIG. 3, the VGT 30 includes a shaft 34 having a first end 36 and a second end 38. The shaft 34 is supported for rotation about an axis 40 via bearings 42. The bearings 42 are mounted in a bearing housing 44 and may be lubricated by a supply of oil. A turbine wheel 46 is mounted on the shaft 34 proximate to the first end 36 and configured to be rotated about the axis 40 by the exhaust gases 23 emitted from the cylinders 14. The turbine wheel 46 is retained inside a turbine housing 48 that includes a volute or scroll 50. The scroll 50 defines an inlet 54 to the turbine wheel 46. The scroll 50 receives the post-combustion exhaust gases 23 and directs the exhaust gases to the turbine wheel 46 through the inlet 54. As a result, the turbine wheel 46 and the shaft 34 are rotated together by the exhaust gases 23 about the axis 40. The scroll 50 is configured to achieve specific performance characteristics, such as efficiency and response, of the VGT 30.

The VGT 30 also includes a variable position vane mechanism 52. As shown, the vane mechanism 52 includes a plurality of movable vanes 56 arranged at the inlet 54. Each vane 56 is mounted and rotatable with respect to the turbine housing 48 via individual pin or axle arrangement 57. The axle arrangement 57 may be a light-duty single-axle mechanism, wherein each respective axle arrangement includes a single pin attached to one side of the turbine housing 48 (as shown in FIG. 3). The axle arrangement 57 may also be a heavy-duty double-axle mechanism, wherein each respective axle arrangement includes two pins, and each pin is attached to one side of the turbine housing 48 (not shown, but understood by those skilled in the art). The vanes 56 are configured to move relative to the turbine housing 48 in order to select a specific aspect ratio (A:R) of the inlet 54 to the turbine wheel 46. As understood by those skilled in the art, the aspect ratio or A:R is defined as the ratio of the width of a shape to its height. The vanes 56 are configured to rotate between and inclusive of fully-opened, where the entry to the inlet 54 is substantially unrestricted via the vanes being positioned substantially parallel to the flow of post-combustion exhaust gases 23, and fully-closed, where the entry to the inlet 54 is blocked via the vanes being positioned substantially orthogonal to the flow of post-combustion exhaust gases. The vane mechanism 52 may also include an actuator 58. As shown, the actuator 58 is configured to selectively vary the position of the vane mechanism 52, and specifically the vanes 56 to select a specific A:R of the inlet 54 to the turbine wheel 46.

The vane mechanism 52 is configured to selectively alter the effective aspect ratio (A:R) of the VGT 30 by altering the effective geometry of the turbine housing 48 in line with operating speed of the ICE 10 and thus facilitate increased ICE operating efficiency. Operating efficiency of the ICE 10 can be increased through the use of the vane mechanism 52 because during lower operating speeds of a typical ICE optimum A:R is very different from the A:R that would be optimum during higher operating speeds. In a fixed A:R turbocharger, if the A:R is too large, the turbocharger may produce insufficient boost at lower speeds, on the other hand, if the A:R is too small, the turbocharger may choke the ICE 10 at higher speeds, leading to increased exhaust backpressure and pumping losses, and ultimately result in lower power output. By altering the geometry of the turbine housing 48 as the ICE 10 accelerates, the A:R of VGT 30 can be maintained near its optimum. As a consequence of its ability to operate near optimum A:R, the VGT 30 will exhibit a reduced amount of boost lag, have a lower boost threshold, and will also be more efficient at higher engine speeds in comparison to a fixed A:R turbocharger. An additional benefit in the VGT 30 is that the VGT does not require and typically does not include a wastegate to regulate rotational speed of the turbine wheel 46.

The VGT 30 also includes a compressor wheel 60 mounted on the shaft 34 between the first and second ends 36, 38. The compressor wheel 60 is configured to pressurize the airflow 26 being received from the ambient for eventual delivery to the cylinders 14. The compressor wheel 60 is retained inside a compressor cover 62 that includes a volute or scroll 64. The scroll 64 receives the airflow 26 from the compressor wheel 60 after the airflow has been compressed. The scroll 64 is configured to achieve specific performance characteristics, such as peak airflow and efficiency of the VGT 30. Accordingly, rotation is imparted to the shaft 34 by the post-combustion exhaust gases 23 energizing the turbine wheel 46, and is in turn communicated to the compressor wheel 60 owing to the compressor wheel being fixed on the shaft. As understood by those skilled in the art, the variable flow and force of the post-combustion exhaust gases 23 influences the amount of boost pressure that may be generated by the compressor wheel 60 throughout the operating range of the ICE 10.

After the post-combustion exhaust gases 23 have passed through the scroll 50 and rotated the turbine wheel 46 together with the compressor wheel 64, the post-combustion exhaust gases exit the turbine housing 48 via an outlet 66 and are directed into an exhaust system 68. The exhaust system 68 is configured to channel the exhaust gases 23 from the ICE 10 to the ambient. As shown, the exhaust system 68 includes a number of exhaust after-treatment devices configured to methodically remove largely carbonaceous particulate byproducts of engine combustion from the post-combustion exhaust gases 23 and reduce emissions of such particulates to the ambient. As shown in FIG. 1, such exhaust after-treatment devices may include a diesel oxidation catalyst (DOC) 70, a selective catalytic reduction (SCR) catalyst 72, and a diesel particulate filter (DPF) 74. The exhaust system 68 also includes an exhaust pressure modulation (EPM) valve 76, which may be configured to route or redirect the post-combustion exhaust gases 23 from the exhaust system 68 to the VGT 30 for exhaust gas recirculation (EGR).

As shown in FIG. 1, the vehicle 6 also includes a controller 78 having a memory and configured to regulate operation of the ICE 10, and specifically to control exhaust braking in the ICE. The controller 78 may be a central processing unit (CPU) that regulates various functions on the vehicle 6 or a dedicated electronic control unit (ECU) for the ICE 10. In either configuration, the controller 78 includes a processor 78A and tangible, non-transitory memory 78B which includes instructions for the actuator 58 programmed therein. As such, the processor 78A is configured to execute the instructions from memory in the controller 78 to regulate the ICE 10, including the operation of the actuator 58. The actuator 58 may have an electromechanical configuration and be in electronic communication with the controller 78. Accordingly, the actuator 58 may receive a command signal 79 from the controller 78 to vary the position of the vanes 56 and select a specific A:R of the inlet 54. The actuator 58 may also include an internal processor (not shown). In such a case, the actuator 58 would receive pertinent data indicative of vehicle and engine operating conditions from the controller 78, determine appropriate A:R of the inlet 54 for the conditions, and then select the subject A:R of the inlet via the vanes 56.

The vehicle 6 also includes a system 80 for controlling exhaust braking in the ICE 10. The system 80 includes the VGT 30, the EPM valve 76, and the controller 78 to incrementally increase the exhaust backpressure in the ICE 10. During operation of the system 80, the controller 78 is configured to restrict a flow of the post-combustion exhaust gases 23 through the exhaust system 68 via a first partially-closed position of the EPM valve 76. The first partially-closed position of the EPM valve 76 is intended to increase exhaust backpressure in the ICE 10 from normal operating exhaust backpressure to a first pressure value 82 and generate a first stage of exhaust braking in the ICE. Following the increase of the exhaust backpressure in the ICE 10 to the first pressure value 82, the controller 78 is configured to restrict the flow of the exhaust gases 23 through the VGT 30 via closing the adjustable vanes 56 of the VGT. Such closing of the adjustable vanes 56 of the VGT 30 is intended to increase the exhaust backpressure to a second pressure value 84 in the exhaust system 68 and generate a second stage of exhaust braking in the ICE 10. Additionally, the second pressure value 84 in the exhaust system 68 can be achieved by closing the adjustable vanes 56 of the VGT substantially simultaneously with the EPM valve 76 being progressively closed to reach the first partially-closed position.

The controller 78 may also be configured to restrict the flow of the post-combustion exhaust gases 23 through the exhaust system 68 via a second partially-closed position of the EPM valve 76 after the exhaust backpressure in the ICE 10 has been increased to the second pressure value 82. The second partially-closed position of the EPM valve 76 is intended to increase the exhaust backpressure in the exhaust system 68 to a third pressure value 86 and generate a third stage of exhaust braking in the ICE 10. The second partially-closed position of the EPM valve 76 is configured to achieve a greater restriction of the exhaust system 68 relative to the first partially-closed position of the EPM valve. As is reasonably understood from the above description, the first partially-closed position of the EPM valve 76 permits a greater amount of the post-combustion exhaust gases 23 to pass through the exhaust system 68, as compared with the closed adjustable vanes 56 of the VGT 30 together with the EPM valve's first partially-closed position and, consequently, the first pressure value 82 would be lower than the second pressure value 84. Similarly, the second pressure value 84 would be lower than third pressure value 86, once the second partially-closed position of the EPM valve 76 is implemented together with the closed adjustable vanes 56 of the VGT 30. Specifically, the first pressure value 82 may be in a range of 125-175 KPa, the second pressure value 84 may be in a range of 325-350 KPa, and the third pressure value 86 may be greater than 350 KPa.

The gradual increase in the backpressure in the ICE 10 to the first pressure value 82 is intended to establish a specific pressure difference across the adjustable vanes 56 of the VGT 30 prior to increasing the backpressure to the second pressure value 84. The incremental increase in the engine backpressure, as described above, can be especially beneficial for the single-axle embodiment of the axle arrangement 57 (shown in FIG. 3) used to support the vanes 56, where the reduced bending stress on the single-axle arrangement can preserve consistent performance and reliability of the variable position vane mechanism 52 and permit generation of significant exhaust braking in the ICE 10.

The system 80 may also use the controller 78 to incrementally reduce the exhaust backpressure in the ICE 10 once the exhaust braking is no longer required. Specifically, the controller 78 may be configured to unrestrict, i.e., increase, the flow of the post-combustion exhaust gases 23 through the VGT 30 via opening the adjustable vanes 56. Such opening of the adjustable vanes 56 is intended to decrease the exhaust backpressure down to the first pressure value 82 in the exhaust system 68. The controller 78 may be configured to unrestrict the flow of the exhaust gas through the exhaust system 68 via opening the EPM valve 76 following the decrease of the exhaust backpressure in the engine down to the first pressure value 82. Such opening of the EPM valve 76 is intended to decrease the exhaust backpressure in the ICE 10 below the first pressure value 82 to normal operating exhaust backpressure. The opening of the EPM valve 76 may be ramped up in gradual or incremental steps to progressively reduce the exhaust backpressure in the ICE 10.

The transition points between the first, second, and third pressure values, 82, 84, 86 may be based on the exhaust backpressure in the ICE 10 being actually detected and communicated to the controller 78 via a pressure sensor 88. Alternatively, control of transition between the first, second, and third pressure values, 82, 84, 86 may be based on an empirically predetermined duration of time value(s) 89. The predetermined duration of time value(s) 89 can be one or more individual values corresponding to specific transitions between the pressure values 82, 84, 86 and programmed into the controller 78 for regulation of the EPM valve 76 and the adjustable vanes 56 of the VGT 30. The controller 78 may also include a timer 79 to facilitate an appropriate instant for the controller to initiate the transition between the first, second, and third pressure values, 82, 84, 86. Accordingly, in the embodiment employing the timer 79 and the predetermined duration of time value(s) 89 programmed into the controller 78, an actual pressure sensor, such as the above-disclosed sensors 88 for detecting and communicating actual the exhaust backpressure in the ICE 10, may not be required.

Figure 4:
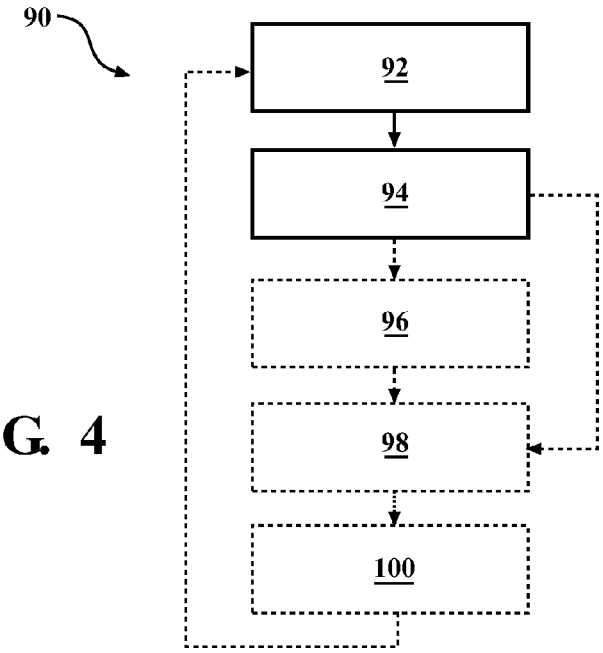
FIG. 4 is a flow diagram of a method used to control exhaust braking in the engine shown in FIGS. 1-2.

FIG. 4 depicts a method 90 of controlling exhaust braking in the ICE 10, as described above with respect to FIGS. 1-3. The method 90 commences in frame 92 with ICE 10 propelling the vehicle 6 and the controller 78 receiving a request, such as from an operator of the vehicle, to initiate exhaust braking in the ICE. In frame 92 the method includes restricting the flow of post-combustion exhaust gases 23 through the exhaust system 68 by the controller 78 via the first partially-closed position of the EPM valve 76. As described above with respect to FIGS. 1-3, the first partially-closed position of the EPM valve 76 increases the exhaust backpressure in the ICE 10 from normal operating exhaust backpressure up to the first pressure value 82 and generates the first stage of exhaust braking in the ICE. Following the increase of the exhaust backpressure in the ICE 10 to the first pressure value in frame 92, the method advances to frame 94.

In frame 94 the method includes restricting a flow of the post-combustion exhaust gases 23 through the VGT 30 by the controller 78 via closing the adjustable vanes 56 of the VGT 30. As described above with respect to FIGS. 1-3, the closing of the adjustable vanes 56 of the VGT 30 increases the exhaust backpressure up to the second pressure value 84 in the exhaust system 68 and generates the second stage of exhaust braking in the ICE 10. Following the increase of the exhaust backpressure in the ICE 10 to the second pressure value 84 in frame 94, the method may advance to frame 96. In frame 96 the method may include restricting the flow of the post-combustion exhaust gases 23 through the exhaust system 68 by the controller 78 via the second partially-closed position of the EPM valve 76. As described above with respect to FIGS. 1-3, the second partially-closed position of the EPM valve 76 is intended to increase the exhaust backpressure in the exhaust system 68 up to the third pressure value 86 and generate the third stage of exhaust braking in the ICE 10.

Following either frame 94 or frame 96, the method may advance to frame 98. In frame 98 the method may include unrestricting the flow of the post-combustion exhaust gases 23 through the VGT 30 by the controller 78 via opening the adjustable vanes 56. As described above with respect to FIGS. 1-3, such opening of the adjustable vanes 56 decreases the exhaust backpressure down to the first pressure value 82 in the exhaust system 68. Following the decrease of exhaust backpressure in the ICE 10 to the first pressure value 82 in frame 98, the method may advance to frame 100. In frame 100 the method may include unrestricting the flow of the post-combustion exhaust gases 23 through the exhaust system 68 by the controller 78 via opening the EPM valve 76 to decrease the exhaust backpressure in the ICE 10 below the first pressure value 82 and down to the normal operating exhaust backpressure.

Following frame 100, the method 90 may loop back to frame 92. Accordingly, the controller 78 may be programmed to continuously monitor the operation of the vehicle 6 and the ICE 10 for controlling exhaust braking in the ICE. The selective control of VGT 30 and the EPM valve 76 by the controller 78 as described above is intended to progressively increase or reduce the exhaust backpressure in the ICE 10 without subjecting the single-axle embodiment of the axle arrangement 57 for the vanes 56 to excessive stress. Furthermore, such progressive control of the exhaust backpressure permits a higher maximum exhaust backpressure to be developed in the ICE 10, which also permits an increased rate of deceleration to be applied to the vehicle 6.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A method of controlling exhaust braking in an internal combustion engine having an exhaust system configured to channel engine exhaust gas to the ambient, an exhaust pressure modulation (EPM) valve, and a variable geometry turbocharger (VGT) having adjustable vanes, the method comprising:

restricting a flow of the exhaust gas through the exhaust system by a controller via a first partially-closed position of the EPM valve to increase exhaust backpressure in the engine up to a first pressure value and generate a first stage of exhaust braking in the engine;

following said increasing the exhaust backpressure in the engine up to the first pressure value, restricting a flow of the exhaust gas through the VGT by the controller via closing the adjustable vanes of the VGT to thereby increase the exhaust backpressure up to a second pressure value in the exhaust system and generate a second stage of exhaust braking in the engine; and following said increasing the exhaust backpressure in the engine up to the second pressure value, restricting the flow of the exhaust gas through the exhaust system by the controller via a second partially-closed position of the EPM valve to increase the exhaust backpressure in the exhaust system up to a third pressure value and generate a third stage of exhaust braking in the engine.

2. The method of claim 1, wherein the first pressure value is in a range of 125 -175 KPa, the second pressure value is in a range of 325-350 KPa, and the third pressure value is greater than 350 KPa.

3. The method of claim 1, wherein the EPM valve is configured to route the exhaust gas from the exhaust system to the VGT for exhaust gas recirculation (EGR).

4. The method of claim 1, wherein the VGT includes a single-axle arrangement for mounting of the adjustable vanes.

5. The method of claim 1, further comprising:

unrestricting the flow of the exhaust gas through the VGT by the controller via opening the adjustable vanes of the VGT to thereby decrease the exhaust backpressure down to the first pressure value in the exhaust system; and following said decreasing the exhaust backpressure in the engine down to the first pressure value, unrestricting the flow of the exhaust gas through the exhaust system by the controller via opening the EPM valve to decrease the exhaust backpressure in the engine below the first pressure value.

6. The method of claim 5, wherein said opening the EPM valve includes ramping open the EPM valve to progressively reduce the exhaust backpressure in the engine.

7. A vehicle comprising:

an internal combustion engine having:

an exhaust system configured to channel engine exhaust gas to the ambient;

an exhaust pressure modulation (EPM) valve; and a variable geometry turbocharger (VGT) having adjustable vanes; and a controller having a memory and configured to:

restrict a flow of the exhaust gas through the exhaust system via a first partially-closed position of the EPM valve to increase exhaust backpressure in the engine up to a first pressure value and generate a first stage of exhaust braking in the engine;

following the increase of the exhaust backpressure in the engine up to the first pressure value, restrict a flow of the exhaust gas through the VGT via closing the adjustable vanes of the VGT to thereby increase the exhaust backpressure up to a second pressure value in the exhaust system and generate a second stage of exhaust braking in the engine; and following the increase of the exhaust backpressure in the engine up to the second pressure value, restrict the flow of the exhaust gas through the exhaust system via a second partially-closed position of the EPM valve to increase the exhaust backpressure in the exhaust system up to a third pressure value and generate a third stage of exhaust braking in the engine.

8. The vehicle of claim 7, wherein the first pressure value is in a range of 125-175 KPa, the second pressure value is in a range of 325-350 KPa, and the third pressure value is greater than 350 KPa.

9. The vehicle of claim 7, wherein the EPM valve is configured to route the exhaust gas from the exhaust system to the VGT for exhaust gas recirculation (EGR).

10. The vehicle of claim 7, wherein the VGT includes a single-axle arrangement for mounting of the adjustable vanes.

11. The vehicle of claim 7, wherein the controller is additionally configured to:

unrestrict the flow of the exhaust gas through the VGT via opening the adjustable vanes of the VGT to thereby decrease the exhaust backpressure down to the first pressure value in the exhaust system; and following the decrease of the exhaust backpressure in the engine down to the first pressure value, unrestrict the flow of the exhaust gas through the exhaust system via opening the EPM valve to decrease the exhaust backpressure in the engine below the first pressure value.

12. The vehicle of claim 11, wherein opening the EPM valve includes ramping open the EPM valve to progressively reduce the exhaust backpressure in the engine.

13. A system for controlling exhaust braking in an internal combustion engine having an exhaust system configured to channel engine exhaust gas to the ambient, the system comprising:

an exhaust pressure modulation (EPM) valve;

a variable geometry turbocharger (VGT) having adjustable vanes; and a controller having a memory and configured to:

restrict a flow of the exhaust gas through the exhaust system via a first partially-closed position of the EPM valve to increase exhaust backpressure in the engine up to a first pressure value and generate a first stage of exhaust braking in the engine;

following the increase of the exhaust backpressure in the engine up to the first pressure value, restrict a flow of the exhaust gas through the VGT via closing the adjustable vanes of the VGT to thereby increase the exhaust backpressure up to a second pressure value in the exhaust system and generate a second stage of exhaust braking in the engine; and following the increase of the exhaust backpressure in the engine up to the second pressure value, restrict the flow of the exhaust gas through the exhaust system via a second partially-closed position of the EPM valve to increase the exhaust backpressure in the exhaust system up to a third pressure value and generate a third stage of exhaust braking in the engine.

14. The system of claim 13, wherein the first pressure value is in a range of 125-175 KPa, the second pressure value is in a range of 325-350 KPa, and the third pressure value is greater than 350 KPa.

15. The system of claim 13, wherein the EPM valve is configured to route the exhaust gas from the exhaust system to the VGT for exhaust gas recirculation (EGR).

16. The system of claim 13, wherein the VGT includes a single-axle arrangement for mounting of the adjustable vanes.

17. The system of claim 13, wherein the controller is additionally configured to:

unrestrict the flow of the exhaust gas through the VGT via opening the adjustable vanes of the VGT to thereby decrease the exhaust backpressure down to the first pressure value in the exhaust system; and following the decrease of the exhaust backpressure in the engine down to the first pressure value, unrestrict the flow of the exhaust gas through the exhaust system via opening the EPM valve to decrease the exhaust backpressure in the engine below the first pressure value.

* * * * *